US011799214B2

(12) United States Patent
Redder et al.

(10) Patent No.: US 11,799,214 B2
(45) Date of Patent: Oct. 24, 2023

(54) CONNECTION ARRANGEMENT AND METHOD FOR CONNECTING A CONNECTION ARRANGEMENT TO A COMPONENT

(71) Applicant: Auto-Kabel Management GmbH, Hausen i.W (DE)

(72) Inventors: Marie Redder, Ebnat-Kappel (CH); Oliver Scharkowski, Guben (DE)

(73) Assignee: Auto-Kabel Management GmbH, Hausen i. W. (DE)

( * ) Notice: Subject to any disclaimer, the term of this patent is extended or adjusted under 35 U.S.C. 154(b) by 0 days.

(21) Appl. No.: 17/913,377

(22) PCT Filed: Mar. 10, 2021

(86) PCT No.: PCT/EP2021/056021
§ 371 (c)(1),
(2) Date: Sep. 21, 2022

(87) PCT Pub. No.: WO2021/197778
PCT Pub. Date: Oct. 7, 2021

(65) Prior Publication Data

US 2023/0129043 A1 Apr. 27, 2023

(30) Foreign Application Priority Data

Mar. 30, 2020 (DE) ..... 10 2020 108 669.5

(51) Int. Cl.
*H01R 4/34* (2006.01)
*H01R 4/02* (2006.01)

(52) U.S. Cl.
CPC ..... *H01R 4/34* (2013.01); *H01R 4/023* (2013.01); *H01R 2201/26* (2013.01)

(58) Field of Classification Search
CPC . H01R 4/30; H01R 4/34; H01R 4/302; H01R 4/4872; H01R 4/023; H01R 2201/26
See application file for complete search history.

(56) References Cited

U.S. PATENT DOCUMENTS 3,313,855 A * 4/1967 Appel ..... C07C 249/02 564/250
3,753,204 A * 8/1973 Thompson ..... H01R 4/646 439/99

(Continued)

FOREIGN PATENT DOCUMENTS

| | | | |
|---|---|---|---|
| DE | 102019104318 | B3 | 3/2020 |
| EP | 3264533 | A1 | 1/2018 |
| TW | 201044727 | A | 12/2010 |

OTHER PUBLICATIONS

European Patent Office, International Search Report and Written Opinion for PCT application PCT/EP2021/056021 dated Jun. 17, 2021, with English translation of ISR, 17 pages.

(Continued)

*Primary Examiner* — Thanh Tam T Le
(74) *Attorney, Agent, or Firm* — Sunstein LLP

(57) ABSTRACT

A connection arrangement comprising a metallic flat conductor having an at least quadrangular cross-sectional profile and at least two opposing surfaces extending longitudinally parallel to each other at least in an end region, a first through-opening between the surfaces in the end region, the first through-opening being formed for receiving a bolt, at least one second through-opening between the surfaces in the end region, the second through-opening being formed to receive a metallic terminal, the terminal being formed as a flat part and bearing flatly with a contact surface against one of the surfaces of the flat conductor in the end region.

14 Claims, 3 Drawing Sheets

(56) References Cited

U.S. PATENT DOCUMENTS

| | | | | |
|---|---|---|---|---|
| 4,023,882 | A * | 5/1977 | Pettersson | H01R 4/26 439/587 |
| 4,256,359 | A * | 3/1981 | Storck | H01R 12/68 439/877 |
| 4,473,714 | A * | 9/1984 | Brownell | F16C 11/02 411/501 |
| 5,110,369 | A * | 5/1992 | Tornstrom | H01L 31/048 136/251 |
| 5,599,211 | A * | 2/1997 | Kurahashi | H01R 4/40 439/806 |
| 6,328,579 | B1 * | 12/2001 | Mori | H01R 4/34 439/97 |
| 6,814,629 | B1 * | 11/2004 | Donfrancesco | H01R 4/301 411/333 |
| 6,939,097 | B2 * | 9/2005 | Carr | F16B 43/00 411/155 |
| 7,044,755 | B2 * | 5/2006 | Hatakeyama | H01R 12/57 439/97 |
| 7,241,152 | B2 * | 7/2007 | Charrier | H01R 4/30 439/97 |
| 9,065,191 | B2 * | 6/2015 | Martin | H01R 11/26 |
| 9,520,657 | B2 * | 12/2016 | Lawson | H01R 11/12 |
| 9,653,194 | B2 * | 5/2017 | Debock | H01B 1/023 |
| 10,236,647 | B2 * | 3/2019 | Kato | H01R 25/161 |
| 10,483,665 | B2 * | 11/2019 | Ishihara | H01R 11/32 |
| 11,394,131 | B2 * | 7/2022 | Scharkowski | H01R 43/0214 |
| 11,441,596 | B2 * | 9/2022 | Johnston | F16B 43/00 |
| 2015/0041211 | A1 | 2/2015 | Debock | |

OTHER PUBLICATIONS

German Patent Office, Office Action issued in application DE 102020108669.5 dated Dec. 4, 2020, 4 pages.

European Patent Office, International Preliminary Report on Patentability for PCT application PCT/EP2021/056201 dated Jun. 14, 2022, 16 pages.

* cited by examiner

CONNECTION ARRANGEMENT AND METHOD FOR CONNECTING A CONNECTION ARRANGEMENT TO A COMPONENT

CROSS-REFERENCE TO RELATED APPLICATIONS

This application is the national phase entry of international patent application no. PCT/EP2021/056021 filed Mar. 10, 2021 and claims the benefit of German patent application No. 10 2020 108 669.5 filed Mar. 30, 2020, the disclosures of which are incorporated herein by reference in their entirety.

TECHNICAL FIELD

The subject matter relates to a connection arrangement with a metallic flat conductor and a terminal as well as a method for connecting a connection arrangement to a component.

BACKGROUND ART

Flat conductors are increasingly being used for the distribution of electrical energy in automotive applications, in particular in motor vehicles, whether passenger cars or trucks. Flat conductors are particularly suitable for power distribution because, above certain conductor cross sections, they have larger surface areas compared with round conductors and thus have improved current-carrying capacity. In particular, flat conductors are used to transmit electrical energy between a battery, a starter and/or a generator. As a so-called energy backbone, a flat conductor is used to distribute electrical energy from a battery to a plurality of loads as well as between a traction battery and a drive motor in electrically powered vehicles. In all cases, the flat conductors have large conductor cross sections. Due to the large conductor cross-sections, aluminium is often used as the metallic material for the flat conductors because it is lighter than copper.

However, when distributing electrical energy in a vehicle, it is necessary to connect the flat conductor electrically to the loads, which requires electrical taps that must be stable over the long term in terms of their mechanical as well as electrical properties. Contact resistances at the taps must be low in order to keep electrical losses at the taps low and to prevent overheating. Very high currents flow in vehicle powertrains in particular, which leads to high ohmic losses at the taps in case the contact resistances are too high.

Especially when used in dynamic environments over a longer period of time, the contact resistance can increase over time. This can occur, among other things, because the contact area between the flat conductor and the connecting part is reduced due to the dynamic load. For example, plastic deformation occurs in dynamic environments, particularly with aluminium, due to its ductile nature. Therefore, care must be taken to ensure that the aluminium is not or only slightly plastically deformed at the tap due to mechanical loads, so as not to negatively influence the contact resistance.

The subject matter was therefore based on the object of providing a terminal for flat conductors that ensures a consistently low contact resistance when used in dynamic environments with long service lives.

SUMMARY OF THE INVENTION

The connection arrangement comprises a metallic flat conductor. A metallic flat conductor is thereby formed in particular from aluminium or an aluminium alloy. This can be, for example, E-aluminium or aluminium 99, 5. The aluminium can in particular be soft annealed.

The flat conductor can be at least partially surrounded by an electrical insulator, for example made of plastic, e.g. silicone or PVC. In an end region, the flat conductor may be free of the insulation. Also, in a center region, the flat conductor may be free of the insulation. End region or center region may be considered as connecting regions.

The flat conductor has a polygonal cross-sectional profile, in particular an at least quadrangular cross-sectional profile. In particular, rectangular or square cross-sectional profiles are preferred. Such a cross-sectional profile is characterized in that the flat conductor has at least two opposing surfaces extending parallel to each other in the longitudinal direction at least in a connecting region.

In the connecting region, the flat conductor has a first through-opening. The through-opening may be drilled, punched, sawed, milled or formed in some other way, for example. The through-opening extends between surfaces that are parallel to each other in the connecting region. The through-opening is formed to receive a bolt, which is inserted through the through-opening to arrange the connection arrangement on a component, as will be described further below.

In addition to the first through-opening between the two surfaces, the flat conductor has at least one second through-opening between the surfaces in the connection area. This second through-opening serves to receive a metallic terminal. In particular, a projection of the terminal is inserted into this second through-opening, as will be described below.

Like the flat conductor, the metallic terminal may be formed of aluminium or an aluminium alloy. It is also possible that the metallic terminal, like the flat conductor, is formed of copper or a copper alloy. The terminal is formed as a flat part and has a flat area formed as a contact surface to the flat conductor. The contact surface abuts one of the surfaces of the flat conductor in the connection area. In the connection area, the contact surface and/or the surface of the flat conductor can be metallically coated, in particular nickel-plated and/or tin-plated. In this case, the metallic coating can be provided alternatively or cumulatively on the flat conductor or on the terminal. Via the terminal, in particular the contact surface of the terminal, a large contact area is provided over which an electric current can flow with low contact resistance.

The aim is now to make this connection at the contact surface between the terminal and flat conductor stable over the long term and to protect it from degradation, particularly in dynamic environments.

For this purpose, it is proposed that the terminal has a first through-recess. The through-recess can be shaped according to the through-opening, for example congruent to it. Also, the through-recess may be drilled, punched, sawed, milled, or otherwise formed.

When the terminal is placed with the contact area against the flat conductor in the connection area, the through-opening and through-recess are aligned with each other.

The aligned first openings/recesses are used to receive a bolt, as will be described below.

To improve long-term stability, at least one projection is formed on the terminal. This projection preferably protrudes substantially vertically from the contact surface.

When the terminal is in contact with the flat conductor with its contact surface in the connection area, not only is the first through-recess aligned with the first through-opening, but the projection is additionally arranged in the second through-opening.

Furthermore, the terminal is connected with its contact surface to the flat conductor in the connection area in a material band (material-locking manner). The terminal, which is preferably formed from a different metal than the flat conductor, enables long-term stable contacting of the flat conductor via the connection arrangement with a component.

The material bonding of the terminal to the flat conductor is preferably carried out by means of ultrasonic welding, friction welding, friction stir welding, resistance welding, laser welding or the like. A full-surface or partial bond between the contact surface and the flat conductor in the connection area is made possible in particular by friction welding, especially ultrasonic welding. Resistance welding is also suitable for ensuring a full-surface bond of the contact surface to the flat conductor. The flat conductor is thus connected/bonded to the flat conductor over a large area via the contact area and is arranged thereon in a mechanically stable manner via the projections.

According to an embodiment, it is proposed that the projection protrudes substantially vertically from the contact surface. The surfaces between which the second through-opening extends are preferably parallel to each other, so that the second through-opening extends perpendicular to the surface. In order to arrange the projection in the second through-opening, the projection is also preferably perpendicularly formed on the contact surface.

According to one embodiment, it is proposed that the projection is substantially cylindrical, in particular hollow cylindrical. The second through-opening may have an inner lateral surface that is congruent with the outer lateral surface of the projection.

In order to absorb clamping forces and to relieve the flat conductor when it is screwed to a component, it is proposed that the projection, starting from the contact surface, has a longitudinal extension which is equal to the distance between the surfaces of the flat conductor in the connecting region. Thus, the length of the projection is equal to the length of the second through-opening (which corresponds to the height of the flat conductor in the connection area), which results in the projection completely filling the through-opening in the inserted state. Thus, a flat part can rest against the projection and the projection absorbs contact forces exerted on the flat part and acting in the direction of the flat conductor, in particular perpendicularly to the surface of the flat conductor in the connecting region.

According to an embodiment, it is proposed that the projection with its outer lateral surface at least partially, in particular completely, abuts against an inner lateral surface of the second through-opening. As a result, current flow is possible not only via the contact surface, but also via the surface at which the projection rests against the inner lateral surface of the through-opening. A particularly good connection is achieved when the projection and the second through-opening have a transition fit or an interference fit.

The projection is preferably formed integrally with the terminal (the flat part). In this case, the terminal can be formed by machining or non-cutting, in particular by means of punching and/or bending. It is possible to press the projections out of the material of the flat part by means of punching when preparing the flat part. An integral design of the projection with the flat part prevents transition resistance from occurring between the projection and the flat part.

According to one embodiment, it is proposed that an end face of the projection is flush with the surface of the flat conductor. The surface of the flat conductor, which is on the side opposite to the terminal, is the surface that is flush with the projection.

According to one embodiment, it is proposed that the number of second through-openings and projections is the same. In particular, more than one second through-opening and projection are provided so that the number of mechanical connections between the terminal and the flat conductor is increased.

According to one embodiment, it is proposed that the geometrical arrangement of the projections around the through-recess is congruent with a geometrical arrangement of the second through-opening around the first through-opening. Thus, it is achieved that the terminal can be inserted into the second through-openings in alignment with the first through-opening with its projections.

According to an embodiment, it is proposed that at least two, preferably at least three second through-openings are arranged at preferably equal angular distances from each other around the first through-opening. In particular, the second through-openings enclose the first through-opening, that is, the second through-openings lie circumferentially around the first through-opening. Preferably, the second through-openings are located on an arc of a circle extending around the first through-opening.

According to an embodiment, it is proposed that a second flat part, for example in the form of a washer is arranged on the surface of the flat conductor opposite the terminal. This flat part preferably lies at least against the end faces of the projections, but in particular simultaneously against the end faces of the projections and the surface of the flat conductor.

A bolt having a flange-like bolt head and a bolt pin extending from the bolt head may be inserted into the second flat part. The second flat part has a receptacle for this purpose, for example an opening, hole or the like.

To attach the connection arrangement to a component, the bolt pin is passed through the second flat part, the first through-opening and the first through-recess and connected to a component such that the second flat part is clamped between the bolt head and the projection. By connecting the bolt to the component, a clamping force acting perpendicularly the second flat part in the direction of the flat conductor can be exerted. This can be done in particular by screwing, if the bolt pin is formed as a screw. This contact pressure is absorbed by the projections, so that the mechanical load on the flat conductor in the connection area is reduced, which is particularly helpful for a long-term stable connection.

According to an embodiment, it is proposed that the bolt is a screw bolt. This can be screwed to the component.

According to an embodiment, it is proposed that the bolt presses the second flat part against the projection in the connected state. The projection absorbs the contact force, so that a defined contact force of the bolt on the flat part is enabled.

According to one embodiment, it is proposed that the first through-opening and/or the first through-recess are formed as a round hole or as an elongated hole.

In another aspect, there is provided a method of connecting a component to a connection assembly as previously described. In this method, the contact surface of the terminal is arranged on the flat conductor. At least the one projection is inserted into at least the one through-opening, although multiple projections may be inserted into multiple through-openings. This arrangement ensures that the first through-opening and the first through-recess are aligned with each other, so that a bolt can be inserted through both of them. After the terminal has been arranged on the flat conductor, the contact surface of the terminal is materially joined to the surface of the flat conductor. On the side of the flat conductor opposite the terminal, a second flat part with a hole is placed against the first through-opening.

A bolt is then inserted into the hole, the first through-opening and the first through-opening to connect the bolt to a component. In the process, the second flat member is clamped between the bolt and the projection.

BRIEF DESCRIPTION OF THE DRAWINGS

Hereinafter, the subject matter will be explained in more detail with reference to a drawing showing embodiments. The drawings show.

DETAILED DESCRIPTION OF SPECIFIC EMBODIMENTS

Figure 1A:
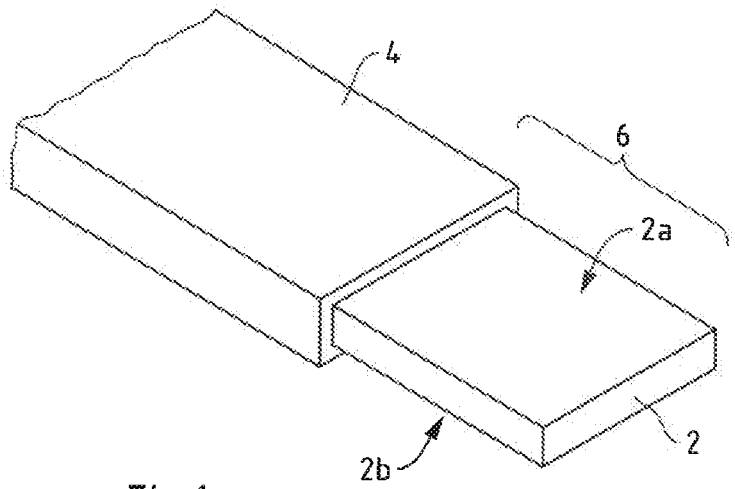
FIG. 1*a, b* flat conductors with connection areas.

FIG. 1*a* shows a flat conductor 2 with an insulation 4. The flat conductor 2 with the insulation 4 can also be referred to as a flat cable. In FIG. 1*a*, the flat cable is stripped in an end region so that the flat conductor 2 is blank in an end region. This end region may be referred to as the connecting region 6.

It can be seen that the flat conductor 2 has a rectangular cross-sectional profile, but square or other polygonal cross-sectional profiles are also conceivable. The flat conductor 2 has two opposite wide surfaces 2*a*, 2*b*, which run parallel to each other in the connection area 6.

Figure 1B:
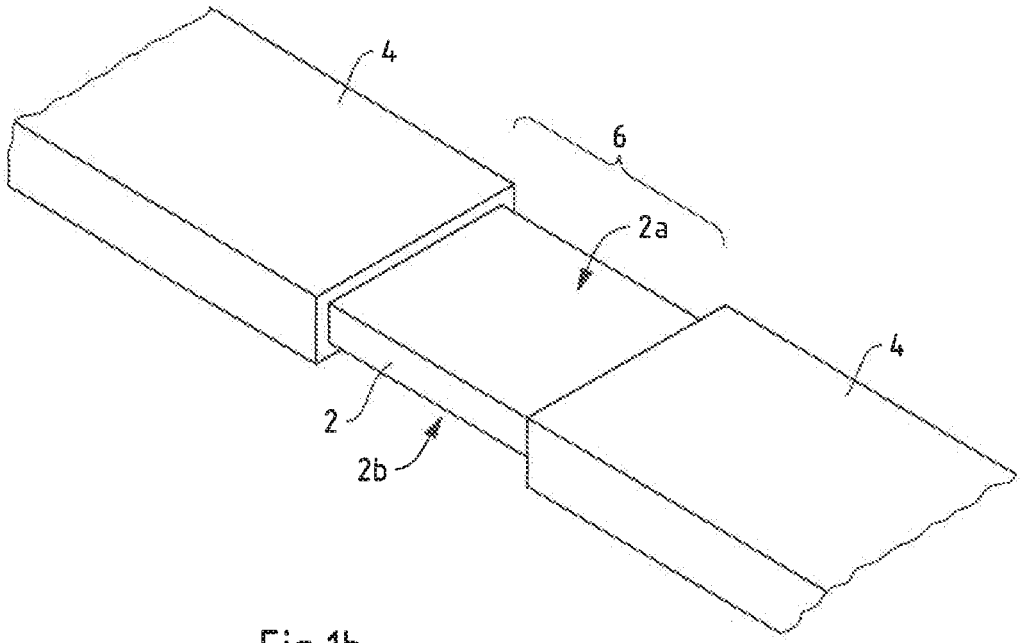

FIG. 1*b* shows the flat conductor 2 in which the connecting area 6 lies between two areas with insulation 4. Here, too, the flat conductor 2 is blank in the connection area 6. Also in this case, wide surfaces 2*a*, 2*b* are parallel to each other.

Figure 2:
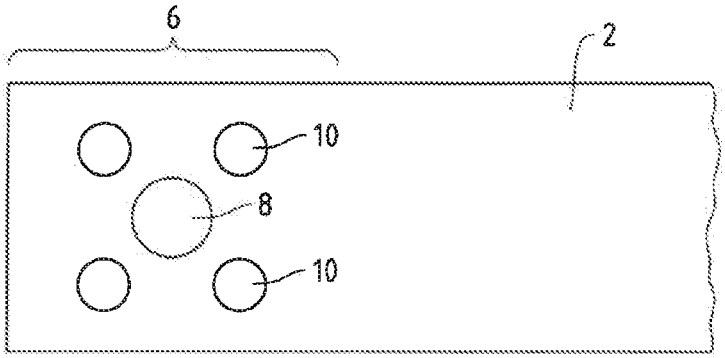
FIG. 2 a top view of a flat conductor with a first through-opening and four second through-openings.

To provide a connection arrangement, it is now proposed that the flat conductor 2 is provided in the connecting region 6 as shown in FIG. 2 with a first through-opening 8 and at least one, in the example shown four, second through-openings 10. The through-openings 8, 10 can be punched, milled, drilled or cut out of the flat conductor 2. It can be seen that the second through-openings 10 surround the first through-opening 8. In particular, the second through-openings 10 are angularly spaced from each other around the first through-opening 8. In this regard, the second through-openings 10 may, for example, lie on an arc around the first through-opening 8.

Figure 3A:
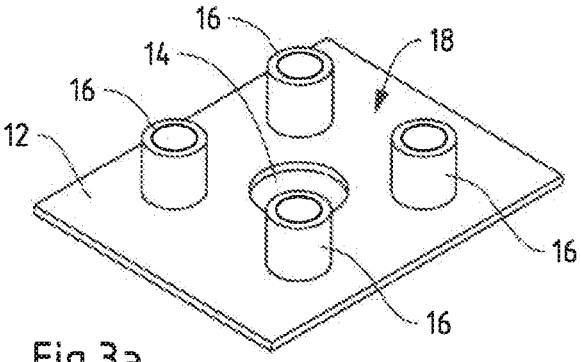
FIG. 3*a, b* a terminal.

After the connection area 6 with the through-openings 8, 10 has been produced, a terminal 12, as shown in FIGS. 3*a, b*, can be applied to the flat conductor 2. FIG. 3*a* shows a view of a terminal 12. The terminal 12 has a through-recess 14. The through-recess 14 can be shaped to correspond to the through-opening 8. In particular, the through-recess 14 has a geometrically congruent or geometrically similar shape to the first through-opening 8. This can be a round hole or an elongated hole, but other shapes are also possible, in particular angular shapes.

The terminal 12 further comprises at least one, preferably more, projections 16. The projections 16 are arranged around the through-opening 14. The geometrical arrangement of through-openings 14 and projections 16 with respect to each other is in particular geometrically congruent with the geometrical arrangement of the first through-opening 8 with respect to the second through-openings 10. The terminal 12 can thus be inserted with its projections 16 into the second through-openings 10. Then, the first through-opening 8 can be aligned with the through-opening 14. On the side of the projections 16, the terminal 12 has a contact surface 18.

Figure 3B:
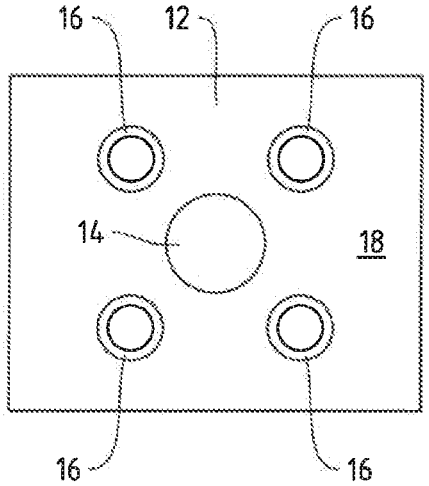

FIG. 3*b* shows a top view of the contact surface 18. It can be seen that the projections 16 are hollow cylindrical in shape. The projections 16 are formed integrally from the terminal 12, in particular by means of punching, bending or the like. The terminal 12 is in particular made of copper or a copper alloy, whereas the flat conductor 2 is in particular made of aluminium or an aluminium alloy. Suitable metallic coatings, in particular tin-plating, nickel-plating or the like, are alternatively or cumulatively possible both on the flat conductor 2 in the connection area 6 and on the terminal 12 at the contact area 18.

To connect the terminal 12 to the flat conductor 2, it is inserted with its projections 16 into the second through-openings 10.

Figure 4:
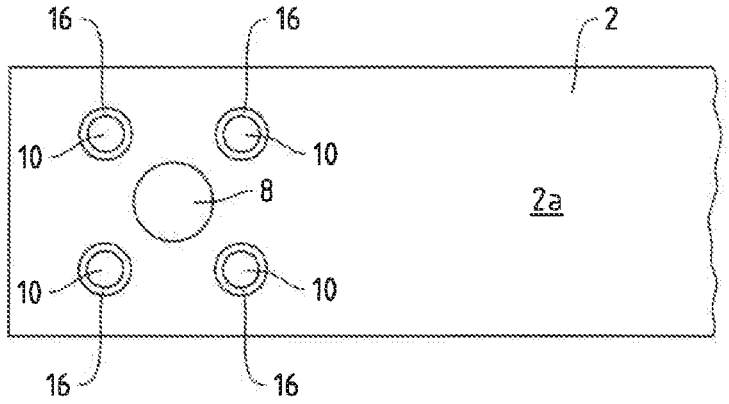
FIG. 4 a flat conductor with a connected terminal.

A top view of the surface 2*a* of the flat conductor 2 is shown in FIG. 4. It can be seen that the projections 16 are inserted in the second through-openings 10.

Figure 5:
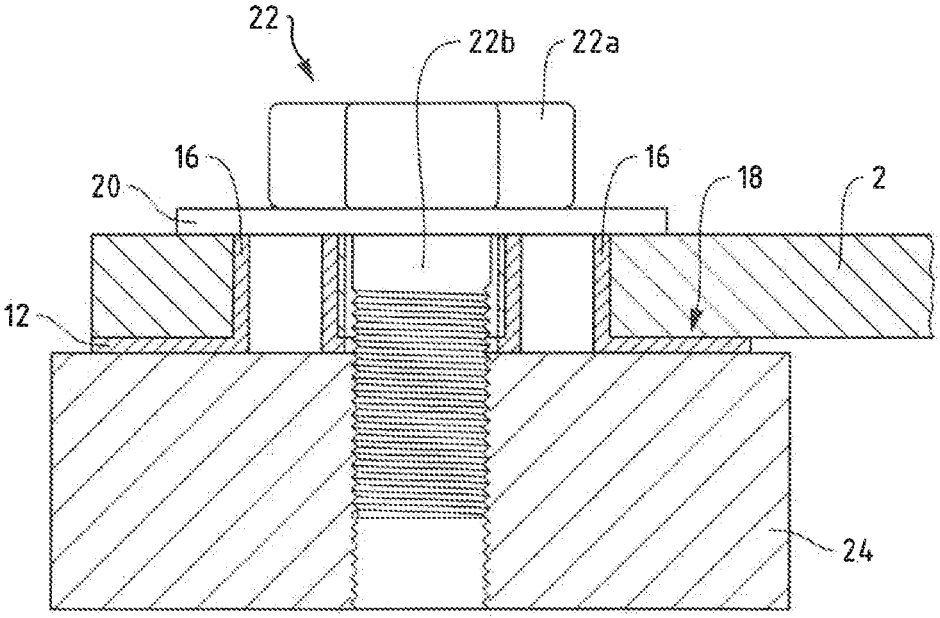
FIG. 5 a longitudinal section through a connection arrangement with a component.

A cross-section in the longitudinal direction to the flat conductor 2 as shown in FIG. 4 can be seen in FIG. 5. It can be seen that the terminal 12 rests with its contact surface 18 against the flat conductor 2. The projections 16 are arranged in the second through-openings 10. In particular, the contact surface 18 is joined to the surface 2*b* of the flat conductor 2 by a material bond. This can be done, for example, by means of ultrasonic welding, resistance welding or the like.

It can be seen that the projections 16 are flush with the surface 2*a* of the flat conductor 2.

After the flat conductor 2 has been joined to the terminal 12, a washer 20 or other flat part is placed on the flat conductor 2 and the projections 16. Then, a screw having a screw head 22*a* and a screw pin 22*b* is screwed into a component 24. In the process, the screw head 22*a* is pressed onto the washer 20, which in turn is pressed against the end faces of the projections 16. The projections 16 absorb the vertical contact pressure force, so that the washer 20 is clamped between the screw head 22*a* and the projections 16 and the flat conductor 2.

By absorbing the contact pressure forces through the projections 16, a long-term stable connection between the flat conductor 2 and the component 24 is made possible.

LIST OF REFERENCE SIGNS

2 flat conductor
4 insulation
6 connection area
8 first through-opening
10 second through-opening
12 terminal
14 through-recess
16 projection
18 contact surface
20 washer
22 screw
24 component

What is claimed is:

1. A connection arrangement comprising:

a metallic terminal, and a metallic flat conductor having a quadrangular cross-sectional profile and two opposing surfaces running, in a connection region, parallel to one another in a longitudinal direction, a first through-opening between the surfaces in the connection region, the first through-opening being formed to receive a bolt, at least one second through-opening between the two opposing surfaces in the connection region, the second through-opening being formed to receive the metallic terminal, wherein the terminal is formed as a flat part and lies flat with a contact surface against one of the two opposing surfaces of the flat conductor in the connection region, wherein the terminal has a first through-recess, arranged in alignment with the first through-opening, the terminal has at least one projection projecting from the contact surface of the terminal, and the projection is arranged in the second through-opening, wherein the at least one projection, starting from the contact surface, has a longitudinal extent that is equal to a distance between the two opposing surfaces of the flat conductor in the connection region, the terminal is materially bonded to the flat conductor at the contact surface.

2. The connection arrangement according to claim 1, wherein the projection projects substantially vertically from the contact surface.

3. The connection arrangement according to claim 1, wherein the projection is essentially cylindrical or hollow cylindrical.

4. The connection arrangement according to claim 1, wherein the projection has an outer lateral surface bearing at least partially or completely against an inner lateral surface of the second through-opening, in particular in that the projection and the second through-opening have a transition fit or an interference fit.

5. The connection arrangement according to claim 1, wherein the projection is integral with the flat part and is formed from the flat part.

6. The connection arrangement according to claim 1, wherein an end face of the projection is flush with one of the two opposing surfaces of the flat conductor.

7. The connection arrangement according to claim 1, wherein the number of said at least one second through-opening and said at least one projection is the same.

8. The connection arrangement according to claim 1, wherein a geometrical arrangement of the at least one projection around the first through recess is congruent with a geometrical arrangement of the at least one second through-opening around the first through-opening.

9. The connection arrangement according to claim 1, wherein at least three second through-openings are arranged at angular distances from each other around the first through-opening.

10. The connection arrangement according to claim 1, wherein the bolt is arranged within the first through-opening, a second flat part is arranged on the one of the two opposing surfaces of the flat conductor opposite the terminal, the bolt has a flange-like bolt head and a bolt pin extending from the bolt head the second flat member is formed to receive the bolt pin, the bolt pin is guided through the second flat part, the first through-opening and the first through-recess and is connected to a component in such a way that the second flat part is held clamped between the bolt head and the projection.

11. The connection arrangement according claim 10, wherein the bolt is a screw bolt.

12. The connection arrangement according to claim 10, wherein the bolt presses the second flat part against the projection in a connected state.

13. The connection arrangement according to claim 1, wherein the first through-opening and/or the first through recess are formed as a round hole or as an elongated hole.

14. A method for connecting a component to a connection arrangement according to claim 1, comprising the steps, arranging the contact surface of the terminal on the flat conductor, wherein the at least one projection is arranged in the at least one second through-opening so that the first through-opening and the first through-recess are aligned with each other, and wherein the at least one projection, starting from the contact surface, has the longitudinal extent which is equal to the distance between the surfaces of the flat conductor in the connection region, materially bonding the contact surface of the terminal to the flat conductor, placing a second flat member having a hole at the through-opening on the surface of the flat conductor opposite to the terminal, inserting the bolt into the hole, the first through-opening, and the first through-recess to connect the bolt to the component so that the flat member is clamped between the bolt and the projection.

* * * * *